US006141816A

United States Patent [19]

Burnett

[11] Patent Number: 6,141,816

[45] Date of Patent: Nov. 7, 2000

[54] DEVICE FOR CLEANING DISHES AND GLASSES

[76] Inventor: John M. Burnett, P.O. Box 22107, London SE18 1ZU, United Kingdom

[21] Appl. No.: 09/271,854

[22] Filed: Mar. 18, 1999

[51] Int. Cl.[7] ..... A47L 17/00

[52] U.S. Cl. ..... 15/164; 15/76; 15/211; 15/74

[58] Field of Search ..... 15/56, 65, 70, 15/74–76, 109.92, 164, 211

[56] References Cited

U.S. PATENT DOCUMENTS

| | | | |
|---|---|---|---|
| 459,927 | 9/1891 | Crees | 15/74 |
| 775,790 | 11/1904 | Yeomans | 15/74 |
| 2,049,365 | 7/1936 | Follett | 15/164 |
| 2,124,748 | 7/1938 | Ransom | 15/164 |
| 2,221,442 | 11/1940 | Cunningham | 15/74 |
| 2,242,361 | 5/1941 | Lewis | 15/76 |
| 2,639,451 | 5/1953 | Ford | 15/76 |
| 3,513,497 | 5/1970 | Cos Vallverdu | 15/74 |
| 3,638,268 | 2/1972 | Van Horn | 15/76 |
| 5,794,301 | 8/1998 | Hietala | 15/104.92 |

*Primary Examiner*—Terrence R. Till

[57] ABSTRACT

A device for cleaning dishes comprising a support having an elongated base horizontally disposed at its lower extent with an outboard end and an inboard end. A connector is essentially vertically disposed between a central extent of the base and one end of the support. The connector has a region at its upper extent with a hole therethrough. Angled fingers extend upwardly at an angle from adjacent the outboard end of the base and angled away from the inboard end of the base to define slots with open upper ends therebetween. The slots have interior surfaces with bristles formed therein extending toward the vertical centers of the slots for receiving dishes to be cleaned therebetween.

7 Claims, 3 Drawing Sheets

FIG 1
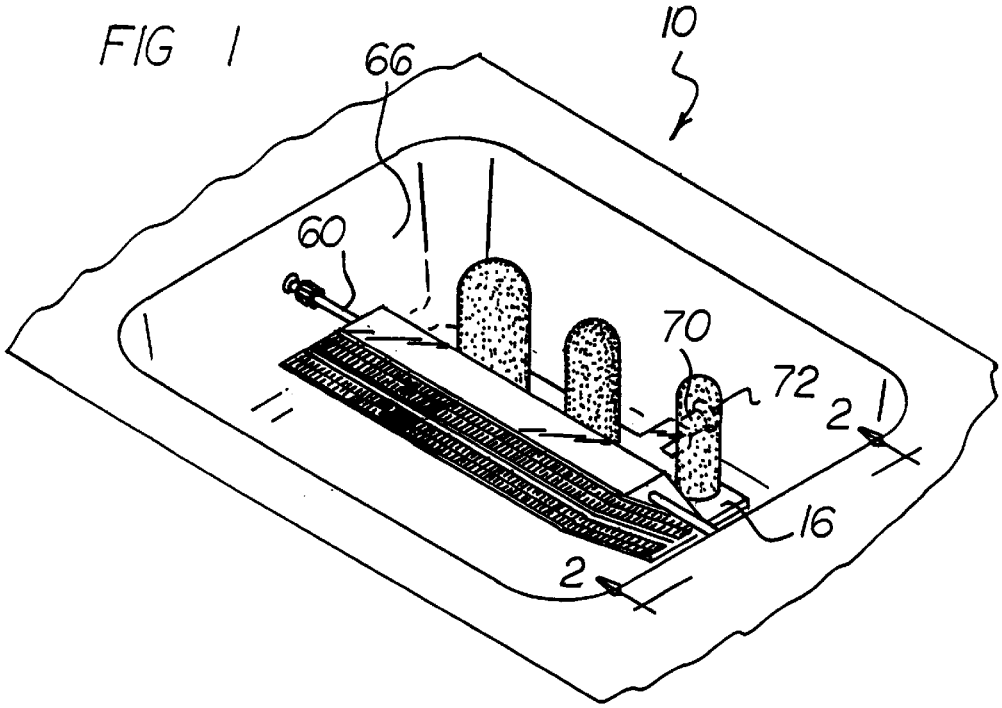
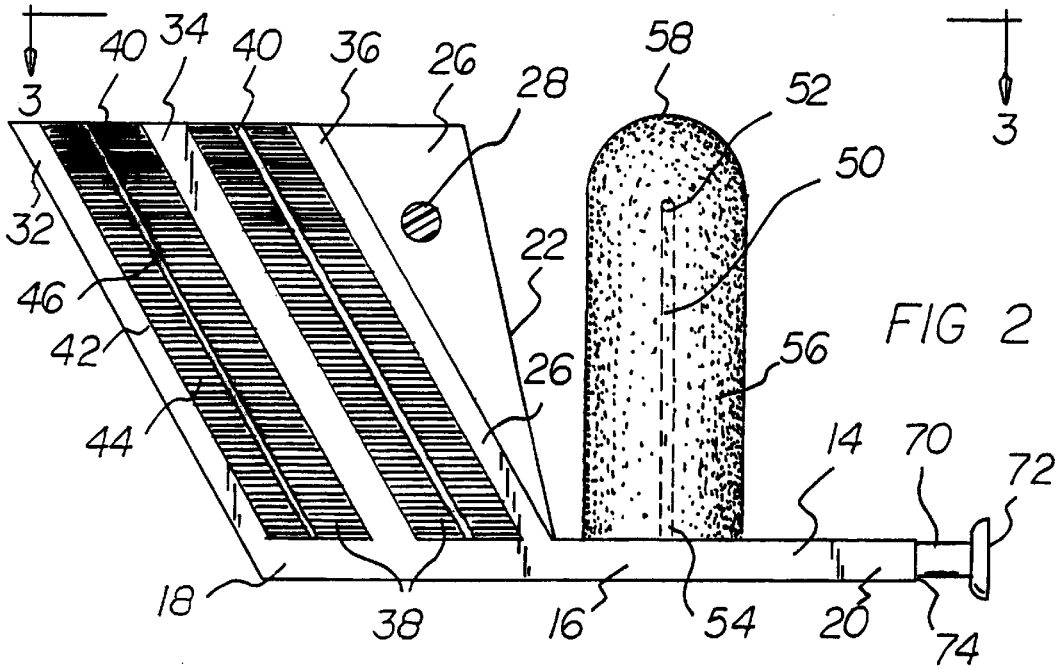
FIG 2

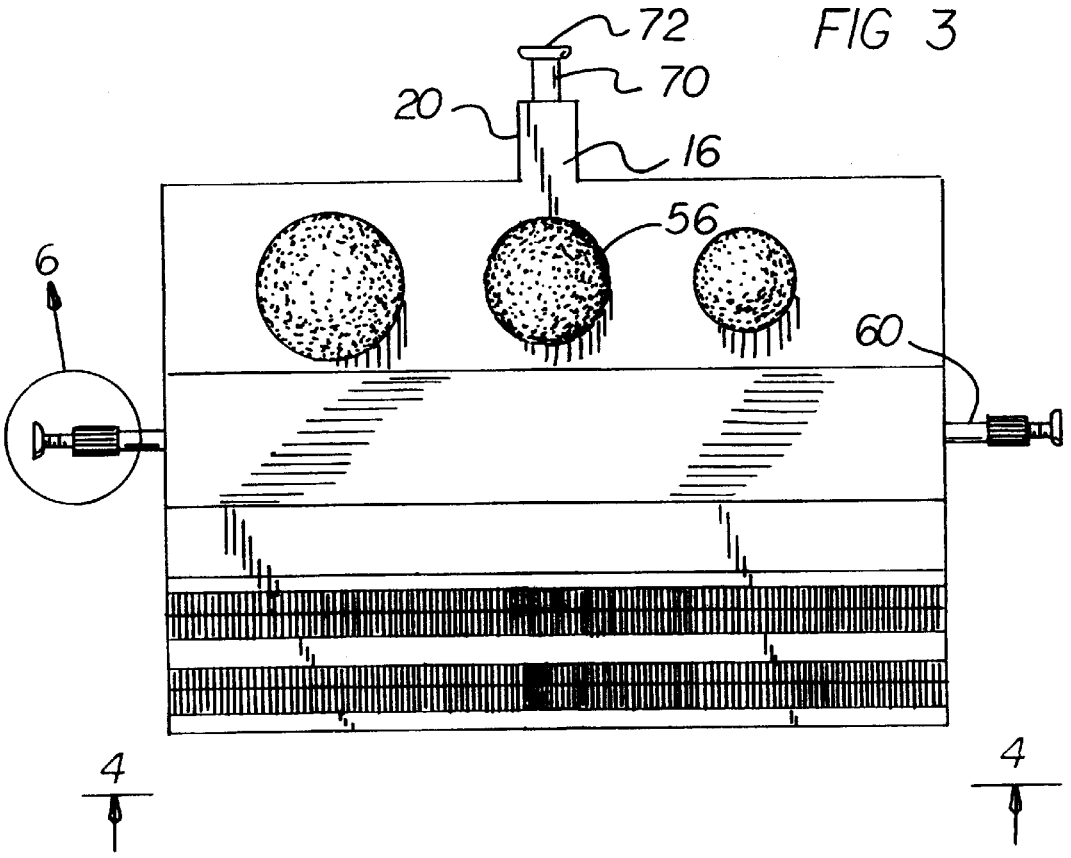
FIG 3
FIG 4
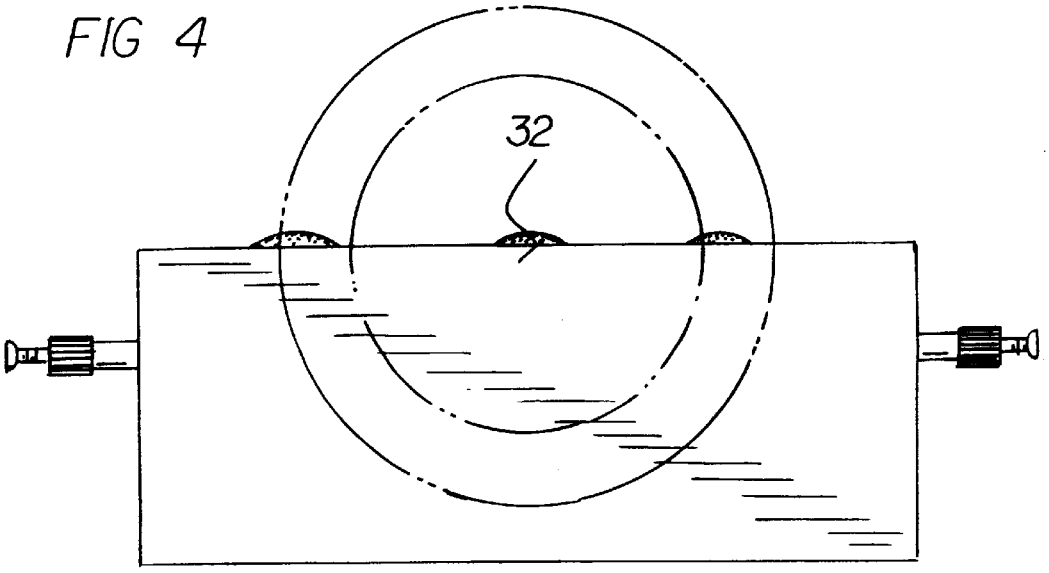

FIG 5
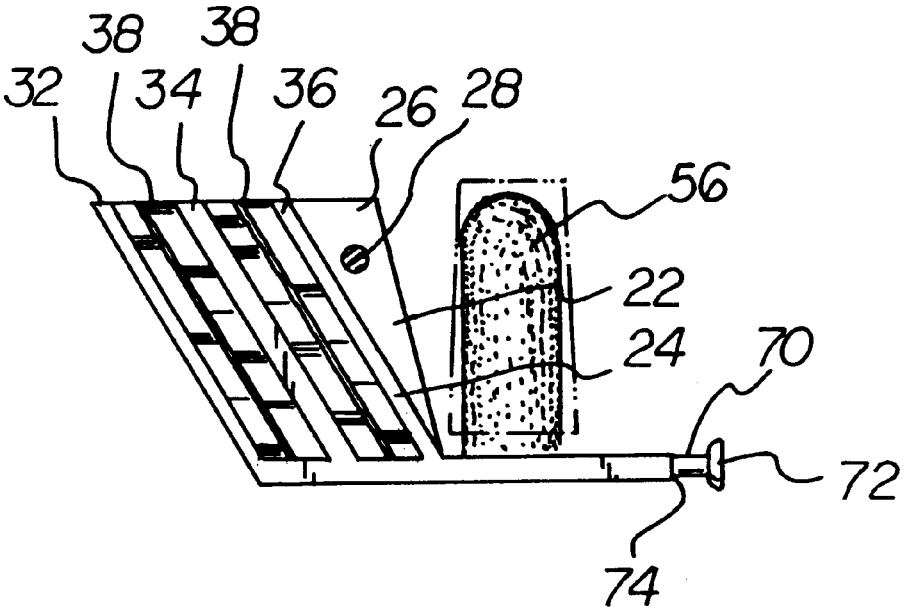
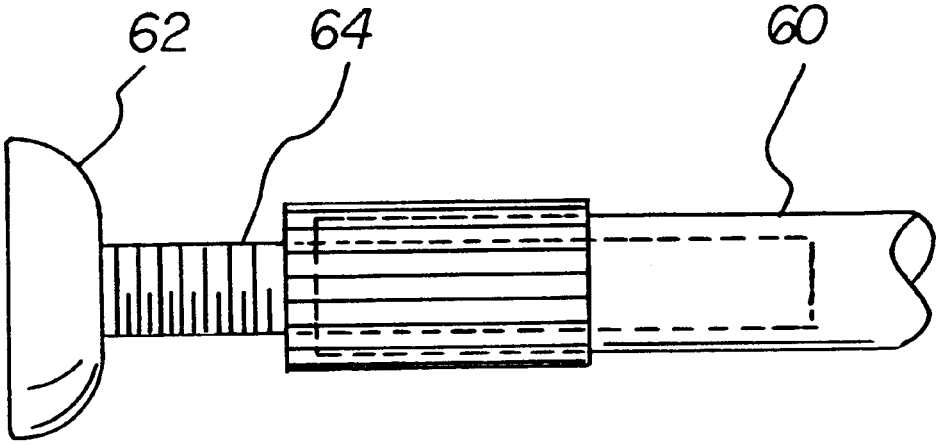
FIG 6

DEVICE FOR CLEANING DISHES AND GLASSES

BACKGROUND OF THE INVENTION

1. Field of the Invention

The present invention relates to a device for cleaning dishes and glasses and more particularly pertains to cleaning dishes and glasses in a sanitary, convenient and cost-effective manner.

2. Description of the Prior Art

The use of devices for cleaning dishes and glasses is known in the prior art. More specifically, devices for cleaning dishes and glasses heretofore devised and utilized for the purpose of cleaning dishes and glasses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,502,176 to Wallace discloses a Bottle Brush/Glass Cleaner. U.S. Pat. No. 4,184,222 to Wootten discloses a Cleaning Device. U.S. Design Pat. No. 335,223 to Shumway et al. discloses a Bottle Brush. U.S. Pat. No. 5,377,362 to Jackson discloses a Combined Sink Strainer Stopper and Scrub Brush. Lastly, U.S. Pat. No. 5,317,779 to Hoagland discloses a Utility Kitchen Brush.

While these devices fulfill their respective, particular objectives and requirements, the aforementioned patents do not describe device for cleaning dishes and glasses that allows cleaning dishes and glasses in a sanitary, convenient and cost-effective manner.

In this respect, the device for cleaning dishes and glasses according to the present invention substantially departs from the conventional concepts and designs of the prior art, and in doing so provides an apparatus primarily developed for the purpose of cleaning dishes and glasses in a sanitary, convenient and cost-effective manner.

Therefore, it can be appreciated that there exists a continuing need for a new and improved device for cleaning dishes and glasses which can be used for cleaning dishes and glasses in a sanitary, convenient and cost-effective manner. In this regard, the present invention substantially fulfills this need.

SUMMARY OF THE INVENTION

In view of the foregoing disadvantages inherent in the known types of devices for cleaning dishes and glasses now present in the prior art, the present invention provides an improved device for cleaning dishes and glasses. As such, the general purpose of the present invention, which will be described subsequently in greater detail, is to provide a new and improved device for cleaning dishes and glasses and method which has all the advantages of the prior art and none of the disadvantages.

To attain this, the present invention essentially comprises a new and improved device for cleaning dishes and glasses in a sanitary, convenient and cost-effective manner. The device comprises a support fabricated of a water-resistant plastic having an elongated base horizontally disposed at its lower extent with an outboard end and an inboard end. A connector is essentially vertically disposed between a central extent of the base and one end of the support. The connector has a triangular region at its upper extent with a circular hole therethrough. Three angled fingers extend upwardly at an angle from adjacent the outboard end of the base and angled away from the inboard end of the base to define two slots with open upper ends therebetween. The slots have interior surfaces with bristles formed therein extending toward the vertical centers of the slots for receiving dishes to be cleaned therebetween. A vertically extending post is provided having an upper free end and a lower end coupled to the base between the fingers and the inboard end of the base with primary bristles extending radially outwardly from the sides thereof and with secondary bristles extending upwardly from adjacent the upper free end and terminating in a hemispherical configuration for receiving and washing glasses. An adjustment upper rod is provided with a circular cross-section and is received within the hole. An adjustable suction cup is positioned on a threaded arm at each end of the upper rod for securement of the upper rod and support in a sink. Lastly provided is an adjustable lower rod with a suction cup and threaded arm received within the inboard end of the base for assisting and positioning the support within a sink.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved device for cleaning dishes and glasses which has all of the advantages of the prior art devices for cleaning dishes and glasses and none of the disadvantages.

It is another object of the present invention to provide a new and improved device for cleaning dishes and glasses which may be easily and efficiently manufactured and marketed.

It is further object of the present invention to provide a new and improved device for cleaning dishes and glasses which is of durable and reliable constructions.

An even further object of the present invention is to provide a new and improved device for cleaning dishes and glasses which is susceptible of a low cost of manufacture with regard to both materials and labor, and which accordingly is then susceptible of low prices of sale to the consuming public, thereby making such device for cleaning dishes and glasses economically available to the buying public.

Even still another object of the present invention is to provide a device for cleaning dishes and glasses for cleaning dishes and glasses in a sanitary, convenient and cost-effective manner.

Lastly, it is an object of the present invention to provide a new and improved device for cleaning dishes comprising a support having an elongated base horizontally disposed at its lower extent with an outboard end and an inboard end. A connector is essentially vertically disposed between a central extent of the base and one end of the support. The connector has a region at its upper extent with a hole therethrough. Angled fingers extend upwardly at an angle from adjacent the outboard end of the base and angled away from the inboard end of the base to define slots with open upper ends therebetween. The slots have interior surfaces with bristles formed therein extending toward the vertical centers of the slots for receiving dishes to be cleaned therebetween.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the device for cleaning dishes and glasses constructed in accordance with the principles of the present invention.

FIG. 2 is a cross-sectional view along line 2—2 of FIG. 1.

FIG. 3 is an end view along line 3—3 of FIG. 2.

FIG. 4 is an end view along line 4—4 of FIG. 3.

FIG. 5 is a perspective view along line 2—2 of FIG. 1 while in operation.

FIG. 6 is an enlarged view taken along circle 6 of FIG. 3.

The same reference numerals refer to the same parts through the various Figures.

DESCRIPTION OF THE PREFERRED EMBODIMENT

With reference now to the drawings, and in particular to FIG. 1 thereof, the preferred embodiment of the new and improved device for cleaning dishes and glasses embodying the principles and concepts of the present invention and generally designated by the reference numeral 10 will be described.

The present invention, the device for cleaning dishes and glasses 10 is comprised of a plurality of components. Such components arc individually configured and correlated with respect to each other so as to attain the desired objective.

The present invention is a new and improved device for cleaning dishes and glasses in a sanitary, convenient and cost-effective manner. The device 10 comprises a support fabricated of a water-resistant plastic 14 having an elongated rectangular base 16 horizontally disposed at its lower extent with an outboard end 18 and an inboard end 20.

A connector 22 is essentially vertically disposed between a central extent of the base and one end of the support. The connector has a triangular cross-section 26 along with a circular hole 28 therethrough.

Three planar, parallel and angled fingers 32, 34, 36 extend upwardly at an angle adjacent to one end of the base and angled away from the inboard end of the base to define two slots 38 with open upper ends 40 therebetween. The slots 38 have interior surfaces 42 with bristles 44 formed therein extending toward the vertical centers 46 of the slots 38 for receiving dishes to be cleaned therebetween. The bristles of one of the slots includes large bristles for plates and large kitchen utensils while another one of the slots includes smaller bristles for medium and small plates including knives, forks and spoons and the like. As an option, a side extent of an upper edge of each of the fingers may be beveled, as shown in FIG. 1.

At least one vertically extending post 50 is provided having an upper free end 52 and a lower end 54 coupled to the base between the fingers and the inboard end of the base with primary bristles 56 extending radially outwardly from the sides thereof and with secondary bristles 58 extending upwardly from adjacent the upper free end and terminating in a hemispherical configuration for receiving and washing glasses. The bristles thus have a lower cylindrical portion and an upper hemispherical portion. Preferably, the present invention includes three separate posts with bristles mounted on the base along a laterally extending line. Such three separate posts with bristles are preferably of different sizes, one small, one medium and one large. In this way the utility of the present invention is increased due to the ability to accommodate the washing of glasses, cups and the like of various sizes.

An adjustment upper rod 60 with a circular cross-section is received within the laterally extending hole formed in the central extent of the connector. An adjustable suction cup 62 is mounted on a threaded arm 64 which is in turn screwably coupled to each end of the upper rod 60 for securement of the upper rod 60 and support in a sink 66.

An adjustable lower rod 70 is provided with a suction cup 72 and threaded arm 74 similar to that of the upper rod. The adjustable lower rod is received within a mount positioned at a central extent of the inboard end of the base for assisting and positioning the support within a sink 66. It should be noted that the adjustable lower rod resides along an axis which remains perpendicular with respect to the adjustable upper rod. As an option, a pair of adjustment sleeves with internal threads may be rotatably coupled to the adjustable rods and further threadedly engaged with the threaded arms for conveniently extending and retracting the same.

The concept of the present invention is a kitchen cleaning tool that would ease the chore of washing dishes.

The present invention consists of a plastic unit that would be placed into a sink bowl or wash basin. It would be secured to the sides of the sink or wash basin by the use of rubber arm stops. It would feature a brush in the center for use when cleaning cups and glasses. Two sets of bristles brushed for cleaning plates and saucers would be conveniently angled for ease in washing plates and saucers. Soap and/or liquid detergent could be easily applied to each cleaning brush. A user would simply place a cup over the center brush and twist back and forth. The angled brush works in an up-and-down motion to effortlessly scrub away hardened food on dishes for greater sanitation and cleanliness. The present invention provides an easier and quicker means of washing dishes that would replace standard dish rags and brushes. The present invention measures 13 centimeters high, up to 46 centimeters long, and 19 centimeters wide and could be produced in a wide variety of colors to match the decor of any kitchen.

The present invention fulfills the need for a kitchen cleaning tool for use in cleaning cups, dishes, etc., in a quick and easy manner.

The appealing features of the device would be its convenience, ease of use, efficiency, and time and energy savings. This cleaning gadget would be far less expensive to purchase and to use on a daily basis than an automatic dishwasher. It would be used to quickly and thoroughly clean dish and other cook ware. It would be used to eliminate the use of scouring pads that can leave food particles behind. It would also eliminate the hassle of soaking dishes in water to remove hardened food particles, which can be time-consuming and ineffective.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new and improved device for cleaning dishes and glasses in a sanitary, convenient and cost-effective manner comprising, in combination:

a support fabricated of a water-resistant plastic having an elongated base horizontally disposed at its lower extent with an outboard end and an inboard end, and a connector essentially vertically disposed between a central extent of the base and one end of the support, the connector having a triangular region at its upper extent with a circular hole therethrough;

three angled fingers extending upwardly at an angle from adjacent the outboard end of the base and angled away from the inboard end of the base to define two slots with open upper ends therebetween, the slots having interior surfaces with bristles formed therein extending toward the vertical centers of the slots for receiving dishes to be cleaned therebetween;

a vertically extending post having an upper free end and a lower end coupled to the base between the fingers and the inboard end of the base with primary bristles extending radially outwardly from the sides thereof and with secondary bristles extending upwardly from adjacent the upper free end and terminating in a hemispherical configuration for receiving and washing glasses;

an adjustment upper rod with a circular cross-section received within the hole and an adjustable suction cup on a threaded arm at each end of the upper rod for securement of the upper rod and support in a sink; and an adjustable lower rod with a suction cup and threaded arm received within the inboard end of the base for assisting and positioning the support within a sink.

2. A device for cleaning dishes comprising:

a support removably mounted in a sink;

a plurality of bristle assemblies coupled to the support for cleaning various entities; and wherein the support is removably coupled in the sink via extendible arms.

3. The device as set forth in claim 2 wherein the bristle assembly includes a vertically extending post having an upper free end and a lower end coupled to the support with bristles extending radially outwardly therefrom such that the bristle assembly is adapted for receiving and washing glasses.

4. The device as set forth in claim 2 wherein the bristle assembly includes at least one slot defined by a pair of substantially planar fingers for receiving plates for cleaning purposes.

5. The device as set forth in claim 2 wherein the support is removably coupled within the sink via suction cups.

6. The device as set forth in claim 2 wherein a pair of arms are included which remain in perpendicular relationship.

7. A device for cleaning dishes comprising:

a support adapted for removably mounting in a sink;

a plurality of bristle assemblies coupled to the support for cleaning various entities;

wherein the support is removably mountable in the sink via extendible arms;

wherein the bristle assembly includes an upwardly extending member having an upper free end and a lower end coupled to the support with bristles extending radially outwardly therefrom such that the bristle assembly is adapted for insertion into drinking glasses; and wherein the bristle assembly includes at least one slot having a plurality of bristles extending from each of the sides toward the other of the sides.

* * * * *